US011791571B2

(12) United States Patent
Maupin et al.

(10) Patent No.: US 11,791,571 B2
(45) Date of Patent: Oct. 17, 2023

(54) CRIMP PIN ELECTRICAL CONNECTOR

(71) Applicant: GE AVIATION SYSTEMS LLC, Grand Rapids, MI (US)

(72) Inventors: Brian Matthew Maupin, Dayton, OH (US); John S Mears, Cincinnati, OH (US)

(73) Assignee: GE Aviation Systems LLC, Grand Rapids, MI (US)

( * ) Notice: Subject to any disclaimer, the term of this patent is extended or adjusted under 35 U.S.C. 154(b) by 0 days.

(21) Appl. No.: 16/912,956

(22) Filed: Jun. 26, 2020

(65) Prior Publication Data

US 2021/0408699 A1 Dec. 30, 2021

(51) Int. Cl.
*H01R 13/52* (2006.01)
*H01R 4/20* (2006.01)
*H01R 13/622* (2006.01)

(52) U.S. Cl.
CPC ..... *H01R 4/20* (2013.01); *H01R 13/5202* (2013.01); *H01R 13/622* (2013.01); *H01R 2201/26* (2013.01)

(58) Field of Classification Search
CPC ..... H01R 13/5219; H01R 13/5202; H01R 13/622; H01R 4/20; H01R 2201/26
See application file for complete search history.

(56) References Cited

U.S. PATENT DOCUMENTS 3,297,978 A 1/1967 Stark
4,082,398 A * 4/1978 Bourdon ..... H01R 13/4226 439/595
4,362,350 A * 12/1982 von Harz ..... H01R 13/426 439/607.12
4,387,943 A * 6/1983 Werth ..... H01R 13/424 439/595
4,443,052 A * 4/1984 Eaby ..... H01R 13/622 439/322
4,544,220 A * 10/1985 Aiello ..... H01R 13/424 439/594
4,698,030 A * 10/1987 Ryll ..... H01R 13/436 439/752
4,820,201 A * 4/1989 Van Brunt ..... H01R 13/6592 439/607.3
4,954,794 A * 9/1990 Nieman ..... H01R 13/719 333/182
4,966,560 A 10/1990 Marzouk
4,973,268 A * 11/1990 Smith ..... H01R 13/4365 439/589
4,993,964 A * 2/1991 Trummer ..... H01R 13/443 439/272
5,088,191 A 2/1992 Lazaro et al.
(Continued)

FOREIGN PATENT DOCUMENTS

DE 19630333 A1 2/1997
JP H10223297 A 8/1998
JP 2001349293 A 12/2001

*Primary Examiner* — Thanh Tam T Le
(74) *Attorney, Agent, or Firm* — McGarry Bair PC

(57) ABSTRACT

A crimp pin electrical connector comprising a shell defining an interior with a first and a second opening, a flange circumscribing the shell, an insert located within the interior and extending through the first opening. The insert comprising at least one crimp pin including a crimp and a pin provided within at least one passage included within the interior of the shell.

16 Claims, 5 Drawing Sheets

(56) References Cited

U.S. PATENT DOCUMENTS

| | | | | |
|---|---|---|---|---|
| 5,221,214 | A * | 6/1993 | Martin | E21B 17/028 439/191 |
| 5,257,949 | A * | 11/1993 | Paulus | H01R 13/7197 333/185 |
| 5,336,115 | A * | 8/1994 | Paulus | H01R 13/6666 29/869 |
| 5,509,821 | A * | 4/1996 | Small | H01R 13/5219 439/272 |
| 6,325,669 | B1 * | 12/2001 | Satai | H01R 13/5221 439/587 |
| 6,361,342 | B1 * | 3/2002 | Cox | H01R 13/5205 439/589 |
| 6,814,632 | B1 * | 11/2004 | Peterson | H01R 13/5205 439/589 |
| 7,316,584 | B2 * | 1/2008 | Mackillop | H01R 13/6463 439/607.05 |
| 7,618,287 | B2 * | 11/2009 | Hass | H01R 13/521 439/589 |
| 7,819,694 | B2 | 10/2010 | Miyashita et al. | |
| 8,241,061 | B2 * | 8/2012 | Chazottes | H01R 13/5205 439/587 |
| 8,430,696 | B2 * | 4/2013 | Matsumoto | H01R 13/521 439/733.1 |
| 8,491,323 | B2 * | 7/2013 | Ishibashi | H01R 13/5221 439/205 |
| 9,437,977 | B1 * | 9/2016 | Belack | H01R 43/16 |
| 9,590,350 | B2 | 3/2017 | Plant et al. | |
| 9,960,515 | B2 * | 5/2018 | Uenosono | H01R 13/4223 |
| 10,223,297 | B2 | 3/2019 | Dalal | |
| 10,340,611 | B2 | 7/2019 | Burrow et al. | |
| 10,396,486 | B2 * | 8/2019 | de Chazal | H01R 13/4368 |
| 2013/0032395 | A1 | 2/2013 | Smoll et al. | |

* cited by examiner

CRIMP PIN ELECTRICAL CONNECTOR

TECHNICAL FIELD

This disclosure relates generally to an electrical connector for an electrical assembly, and more specifically to a crimp pin electrical connector.

BACKGROUND OF THE INVENTION

Contemporary aircraft use electric machines, such as electric motors or electric generators for energy conversion. In the aircraft industry, it is common to find an electric motor having a combination of motor and generator modes, where the electric machine, in motor mode, is used to start an aircraft engine, and, depending on the mode, functions as a generator, too, to supply electrical power to the aircraft systems. Electric machines contain electrical components which can in some instances require crimp pin electrical connectors or crimp socket connectors to electrically or communicatively couple separate electrical components. Occasionally, these connections are subject to fluid leakage at the connector, which can contaminate the local electrical components or leak fluid external from a sealed vessel. For crimp pin electrical connectors and crimp socket connectors, the leakage flow path extends from the end of the wire lead insulation, near the crimp barrel, to the inspection hole in the crimp barrel. The end of the wire lead insulation and the inspection hole lie on the external side of a seal, which would otherwise control the fluid leakage.

BRIEF DESCRIPTION OF THE INVENTION

In one aspect, the disclosure relates to a crimp pin electrical connector comprising a shell defining an interior with a first opening and a second opening to define an axial path through the shell between the first opening and the second opening, a flange circumscribing an exterior of the shell, and an insert located within the interior and comprising a first end corresponding to the first opening, a second end corresponding to the second opening, and at least one passage extending between the first end and the second end, the insert comprising: at least one crimp pin corresponding to the at least one passage, with at least some of the at least one crimp pin comprising a pin and a crimp, wherein the at least one crimp pin is located within the at least one passage such that a portion of the at least one crimp pin is located on a first side of the flange and the crimp lies on a second side, opposite the first side, of the flange.

In another aspect, the present disclosure relates to a wall of an electrical assembly comprising a first surface, a second surface opposite the first surface, and a hole located in the wall, a shell defining an interior with a first opening and a second opening to define an axial path through the wall between the first opening and the second opening, the shell having a flange circumscribing an exterior of the shell, with at least a portion of the shell extending through the hole and the flange abutting the first surface, and an insert located within the interior and comprising a first end corresponding to the first opening, a second end corresponding to the second opening, and at least one passage extending between the first end and the second end, the insert comprising at least one crimp pin corresponding to the at least one passage, the at least one crimp pin comprising a pin and a crimp, wherein the at least one crimp pin is located within the at least one passage such that a portion of the pin is axially located on a first side of the flange and the crimp is axially located on a second side of the flange.

BRIEF DESCRIPTION OF THE DRAWING

A full and enabling disclosure of the present description, including the best mode thereof, directed to one of ordinary skill in the art, is set forth in the specification, which refers to the appended FIGS., in which.

DETAILED DESCRIPTION OF THE INVENTION

Figure 1:
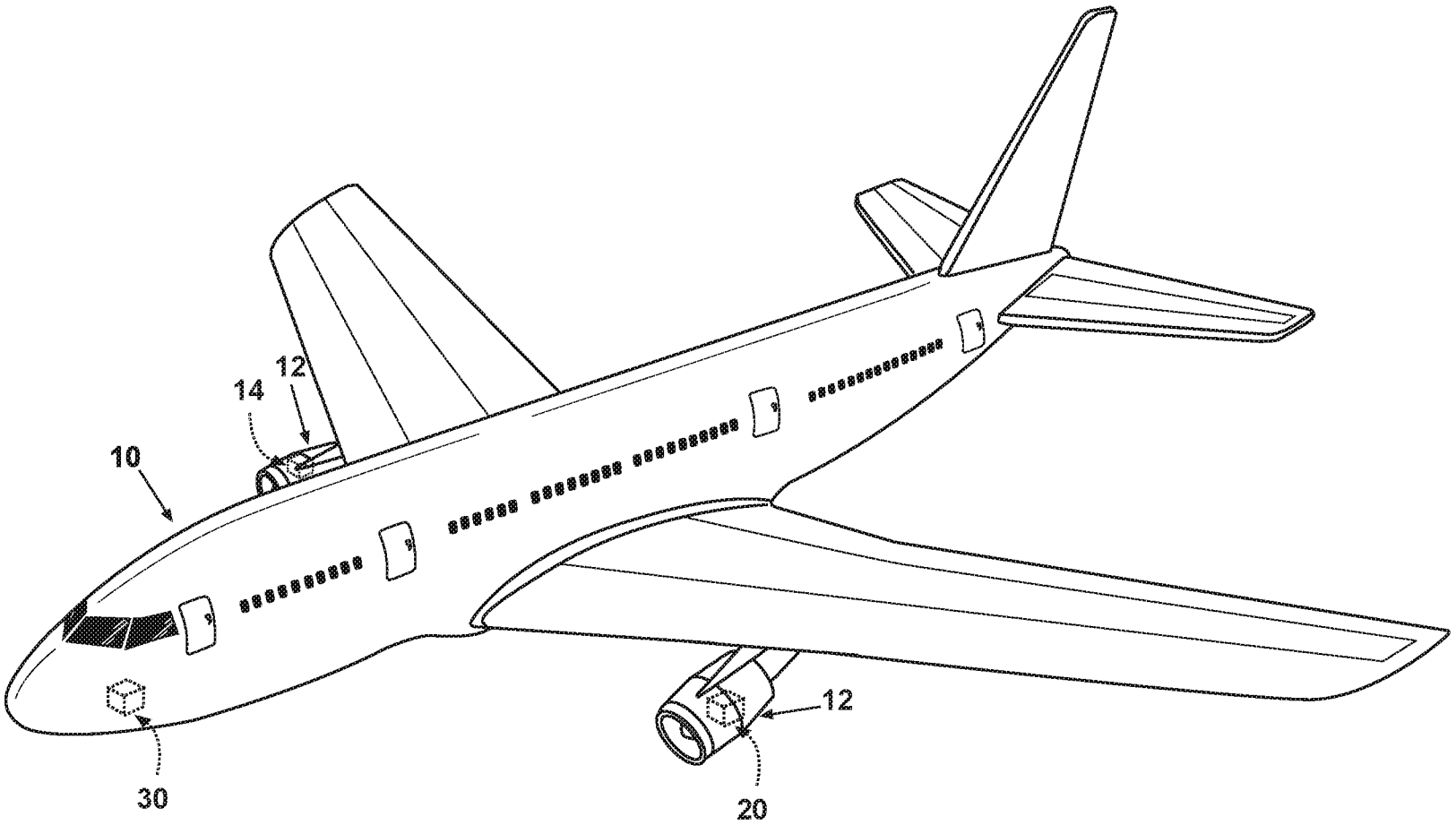
FIG. 1 is a perspective view of an aircraft having an avionics chassis with electrical components and a Back-up Generator in accordance with various aspects described herein.

Aspects of the disclosure relate to an improved crimp pin electrical connector that includes a set of crimp pins extending through at least a portion of a first side to a second side of a housing. Avionics including electrical components, as well as other engine components, are constantly challenged with dissipating the heat produced within the increasing thermal production within the aircraft environment, which can require the use of local liquids or fluids for heat dissipation. Fluids can accumulate near the first side or a sump region of the housing for the crimp pin electrical connector.

While the description will generally pertain to an avionics chassis or a Back-up Generator (BUG) within an aircraft, it should be appreciated that the crimp pin electrical connector can be applicable to a myriad of elements or implementations, such as any electronics chassis, electronics components, motors such as those in an aircraft engine or not in an aircraft, or any other electrical assembly utilizing crimp pin electrical connectors, for example. Therefore, the crimp pin electrical connector as described herein will also have applicability in other environments where sealed electrical connections are desirable, such as non-aircraft, terrestrial, or other environments, as well as any other electrical environment.

While "a set of" various elements will be described, it will be understood that "a set" can include any number of the respective elements, including only one element. Additionally, all directional references (e.g., radial, axial, upper, lower, upward, downward, left, right, lateral, front, back, top, bottom, above, below, vertical, horizontal, clockwise, counterclockwise) are only used for identification purposes to aid the reader's understanding of the disclosure, and do not create limitations, particularly as to the position, orientation, or use thereof. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto can vary.

FIG. 1 schematically illustrates an aircraft 10 including a gas turbine engine 12, specifically two gas turbine engines 12 disposed on respective sides of the aircraft 10. Each gas turbine engine 12 can be a turbofan engine commonly used in modern commercial aviation or it could be a variety of other known gas turbine engines such as a turboprop or turboshaft. Each gas turbine engine 12 can include a BUG 14. As illustrated, the aircraft 10 can include two BUGs 20, one for each gas turbine engine 12. Each BUG 20 can be generally defined as an electric machine such that it can be configured to supply or receive power to various avionic components or systems of the aircraft 10. For example, the BUG 20 can supply mechanical power to an Accessory Gear Box (AGB) (not shown) used to drive at least a portion of the gas turbine engine 12. While a BUG 20 is shown and described, it will be appreciated that the BUG 20, can be any electric machine including, but not limited to, an electric motor or starter/generator.

The aircraft 10 can further include an on-board avionics chassis 30 (shown in broken-line) for housing avionics, electronics, electrical components, or avionics components for use in the operation of the aircraft 10. The avionics chassis 30 houses a variety of avionics elements and protects them against contaminants, electromagnetic interference (EMI), radio frequency interference (RFI), vibrations, and the like. While illustrated in a commercial airliner, the avionics chassis 30 can be used in any type of aircraft as well as any vehicle requiring similar protection. The avionics chassis 30 can be located anywhere within the aircraft, not just the nose as illustrated. Furthermore, aspects of the disclosure are not limited only to aircraft aspects, and can be included in other mobile and stationary configurations. Non-limiting example mobile configurations can include ground-based, water-based, or additional air-based vehicles. Further yet, aspects of the disclosure are not limited to that of an avionics chassis, but any portion of the aircraft electrical connections are made or crimp pin electrical connectors are utilized. Further still, the electrical connections can be those made in an oil-wetted cavity, such as within an on-engine electric motor or generator (e.g., the BUG 20), where it is desirable to seal the wetted cavity and permit electrical connection.

Figure 2:
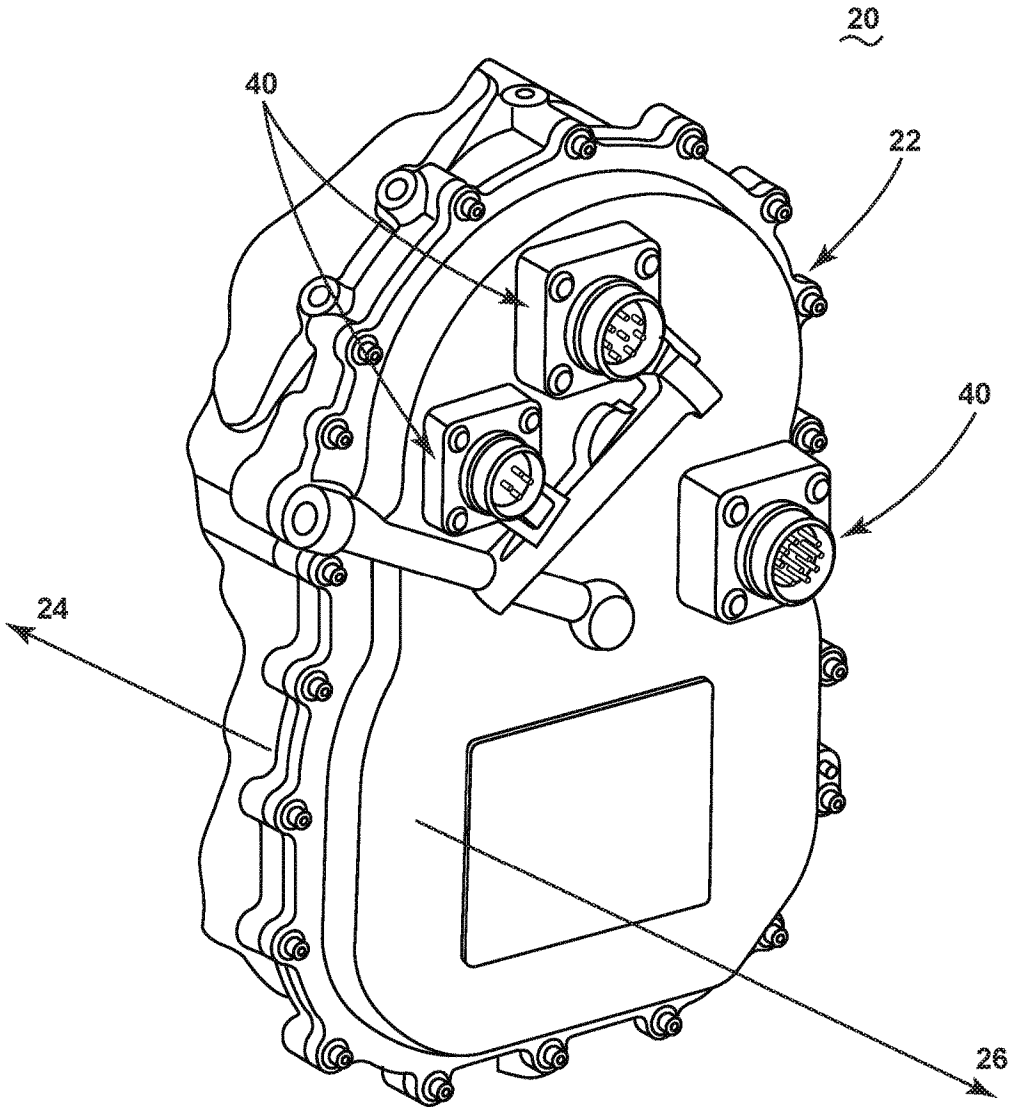
FIG. 2 is an enlarged view of a housing cover of the Back-up Generator of FIG. 1, including a set of crimp pin electrical connectors.

FIG. 2 illustrates a housing cover 22 or wall of the BUG 20 of FIG. 1. The housing cover 22 can be defined as a portion of the BUG 20 which separates a first and a second portion of the BUG 20. The first portion of the BUG 20 can be defined as a region which includes one or more components located within a wet portion of the BUG 20 such as, but not limited to, circuit boards, wire leads, or other electronic components. As used herein, the term "wet" can refer to any component of the aircraft which is susceptible to be exposed or is exposed to fluids such as, but not limited to, coolants, lubricants, water, gas, oil, or any combination thereof. The first portion of the BUG 20 can be defined as a wet region 24. The second region of the BUG 20 can be defined as a portion of the BUG 20 that is not intended to be in direct contact with fluid. The fluids that a portion of the BUG 20 can be exposed to include, but are not limited to, coolants, lubricants, water, oil, gas, or any combination thereof. The second region can be defined as an environment region 26. The environment region 26 can be further defined as a location or portion of the BUG 20 which is exposed to the environmental conditions surrounding exterior portions of the BUG 20. For example, the environment region 26 can be ambient air.

A set of electric pin contacts, specifically a set of crimp pin electrical connectors 40, can extend through the housing cover 22 of the BUG 20. The set of crimp pin electrical connectors 40 can be configured to establish an electrical connection between a set of electronic components within the BUG 20, specifically the wet region 24 of the BUG 20, and a set of external electronic components such as, but not limited to, control systems, health monitoring systems, sensors, generator operations, Full Authority Digital Engine Control (FADEC), or the like. A set of holes extending through the housing cover 22 from a first surface corresponding to the wet region 24 to a second surface corresponding to the environment region 26 can be provided at various locations on the housing cover 22 to receive a corresponding crimp pin electrical connector 40. As illustrated, three holes can be provided to receive a total of three crimp pin electrical connectors 40. The set of holes can be configured to circumscribe at least a portion of the crimp pin electrical connector 40.

Figure 3:
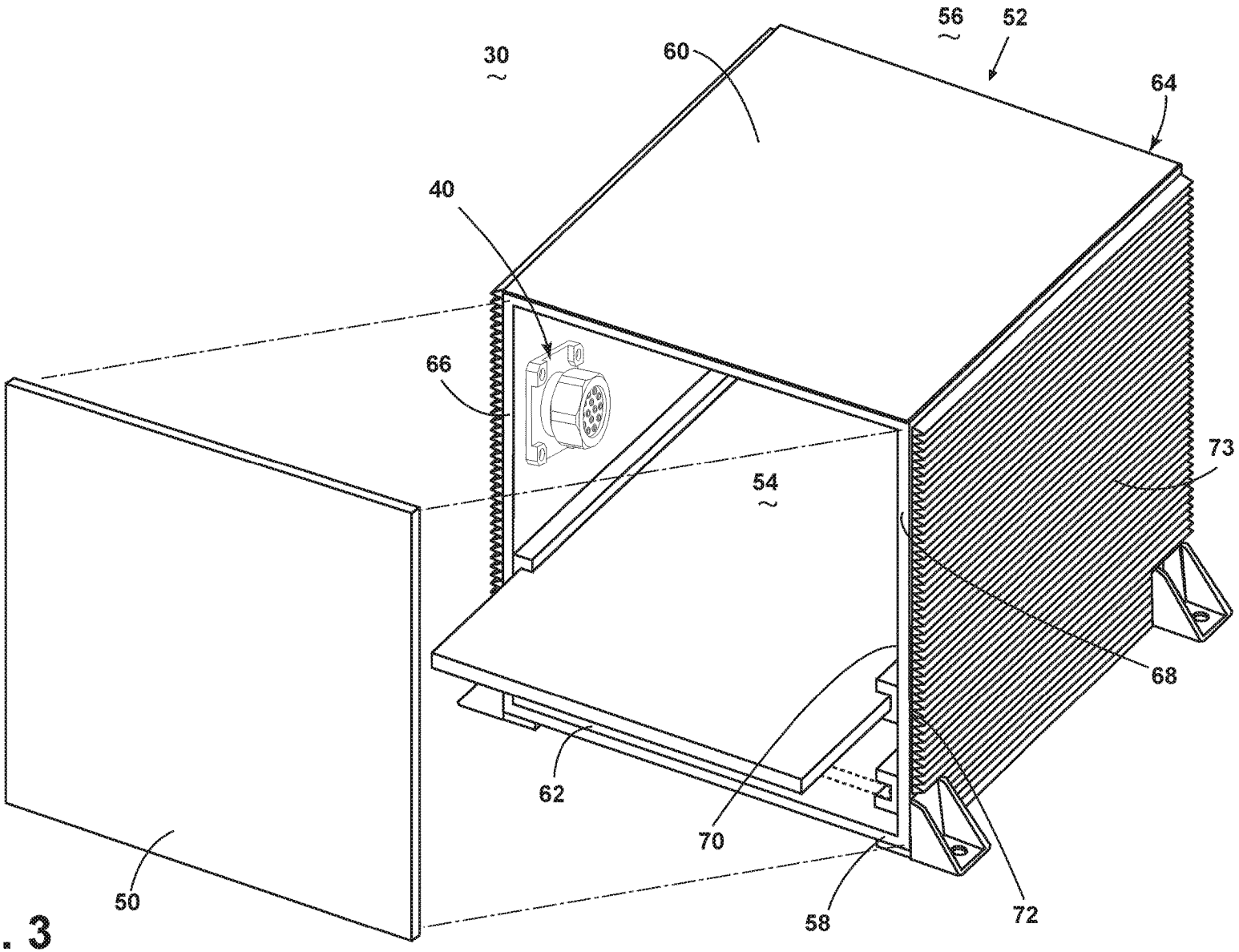
FIG. 3 is an enlarged, partially exploded perspective view of the avionics chassis of FIG. 1, with a cover removed for clarity and including the crimp pin electrical connector.

FIG. 3 illustrates the avionics chassis 30 of FIG. 1. according to an aspect of the present disclosure, with a front cover 50 removed. The avionics chassis 30 includes a chassis housing 52 defining an interior 54 and exterior 56 of the avionics chassis 30. The avionics chassis 30 can include a chassis frame 58 having a top cover 60, a bottom wall 62, a back wall 64, and opposing sidewalls 66, 68, collectively referred to as a set of walls. The chassis frame 58 can further include the aforementioned front cover 50 which can be selectively removed, providing access to the interior 54 of the avionics chassis 30 when removed, and partially restricting access to the interior 54 when coupled or mounted with the chassis frame 58. The sidewalls 66, 68 can include an interior surface 70 and an exterior surface 72. As shown, a set of heat-dissipating elements, such as fins 73, can project from the exterior surface 72 of the sidewalls 66, 68. While heat-dissipating fins 73 are shown, a number of heat-dissipating elements or heat-dissipating configurations can be utilized by the sidewalls 66, 68 to remove or dissipate at least a portion of heat generated by or within the avionics chassis 30, or heat stored by the avionics chassis 30.

The avionics chassis can further include the electric pin contact, specifically the crimp pin electrical connector 40 of FIG. 2. As illustrated, the crimp pin electrical connector 40 can extend through the sidewall 66 from a first surface being the interior surface 70 to a second surface being the exterior surface 72. A hole extending from the first surface to the second surface can be included within the sidewall 66 and be configured to circumscribe at least a portion of the crimp pin electrical connector 40. It is contemplated that the first surface and the second surface can be any opposing surfaces of a specific wall of the set of walls of the avionics chassis 30. Although illustrated as a singular crimp pin electrical connector 40, it will be appreciated that the crimp pin electrical connector 40 can be one of a set of crimp pin electrical connectors 40. The set of crimp pin electrical connectors 40 can be placed on any wall of the set of walls.

Each crimp pin electrical connector 40 can be operatively coupled to one or more electrical components of the aircraft 10. The avionics chassis 30 can be configured to house a set of electronic components used in the operation of the aircraft 10. For example, the interior 54 of the avionics chassis 30 can hold a set of processors, computers, tablets, an Electronic Flight Bag (EFB), or the like. As such, the avionics chassis 30 can be configured to house, support, or include a set of electronic components within the interior 54.

Figure 4:
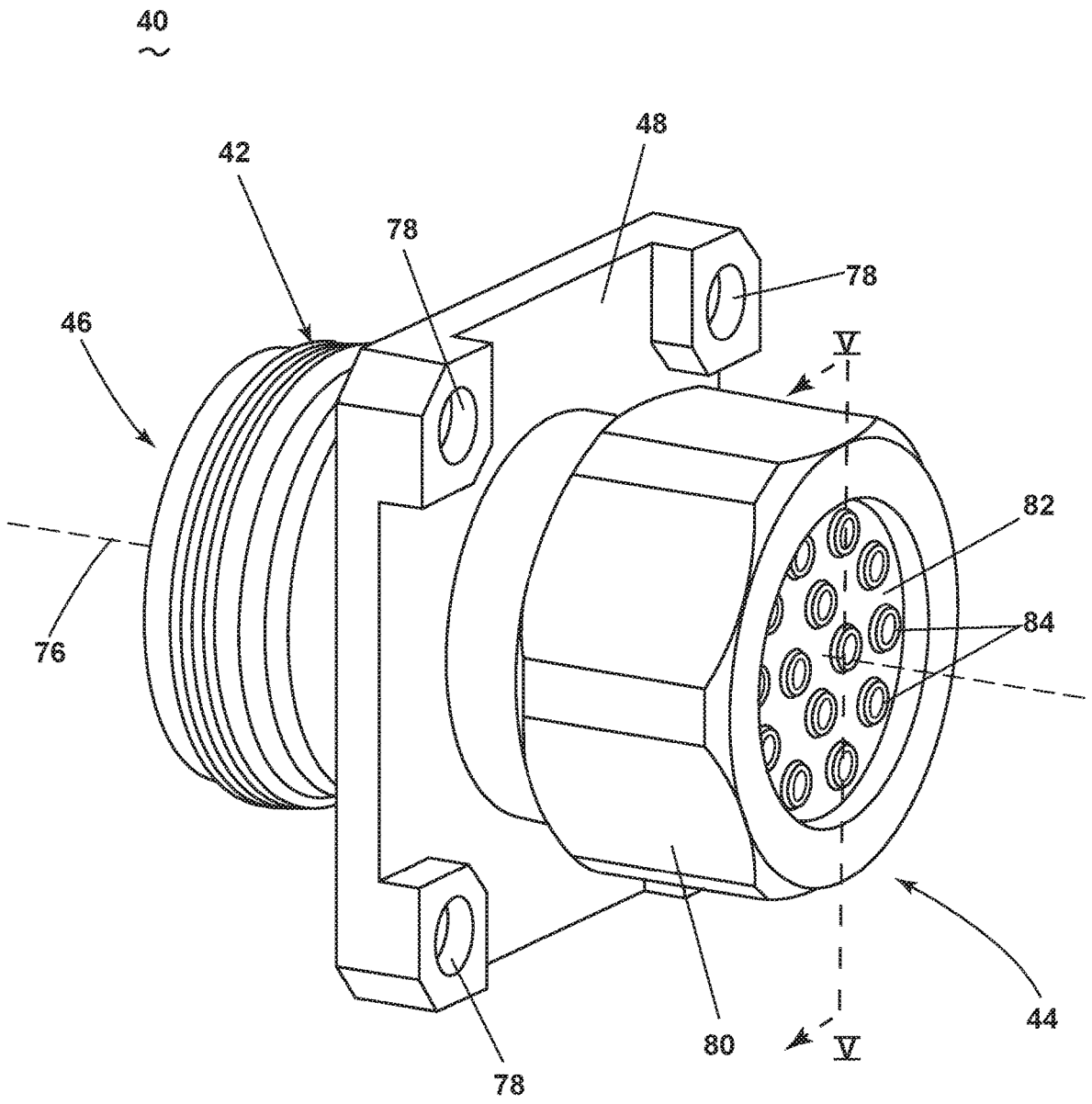
FIG. 4 is a perspective view of the crimp pin electric connector for use in an electrical assembly included within the aircraft of FIG. 1, according to various aspects described herein.

FIG. 4 illustrates the crimp pin electrical connector 40 of FIG. 2 and FIG. 3 for use within an electrical assembly included within the aircraft 10 of FIG. 1. As used herein, it will be appreciated that the electrical assembly can refer to any suitable electrical assembly of the aircraft 10 configured to utilize or otherwise receive the crimp pin electrical connector 40. As such, it will be appreciated that as described herein, the crimp pin electrical connector 40 can extend through any suitable wall of an electrical assembly. Non-limiting examples of the wall of the electrical assembly that the crimp pin electrical connector 40 can extend through can include, but are not limited to, the housing cover 22 of the BUG 20, and the sidewall 66 of the avionics chassis 30.

The crimp pin electrical connector 40 can include a housing 42 having a first opening 44 and a second opening 46 defining a longitudinal axis 76 extending between the first opening 44 and the second opening 46. As such, the first opening 44 and the second opening 46 can define an axial path through the housing 42. The housing 42 can be any suitable crimp-pin connector body or electrical wire connector, such as any commercial-off-the-shelf or custom connector. A flange 48 or a mounting flange can be included as a portion of the housing 42. The flange 48 can abut the first surface of the sidewall 66 or any other wall of the set of walls facing the interior surface 70 of the avionics chassis 30, or any side of the housing cover 22 of the BUG 20 such that the flange 48 can be fastened to the wall or housing cover 22 through use of a set of fastener apertures 78 provided in the flange 48. Although the flange 48 is specifically illustrated as being a 4-bolt mounting flange, it will be appreciated that the flange 48 can be any sort of mount for the crimp pin electrical connector 40. Specifically, the crimp pin electrical connector 40 can be configured to include the housing 42 being any environmentally resistant circular electrical connectors with any sort of flange configured to be mounted to an exterior wall or surface through any suitable mounting style such as, but not limited to, a jam nut, a weld mount, or the like.

A nut 80 and a cap 82 are provided at the first opening 44, including a set of inlets 84 for accepting a set of wires connected to at least a portion of the crimp pin electric connector 40, specifically, a set of crimp contacts as described herein. The nut 80 can be made of steel, for example, while other materials are contemplated, such as non-conductive materials such as plastics. The cap 82 can be made of dielectric materials due its proximity to the set of wires which can extend through the set of inlets 84. For example, the cap 82 can be made of polyamide-imide or the like.

Figure 5:
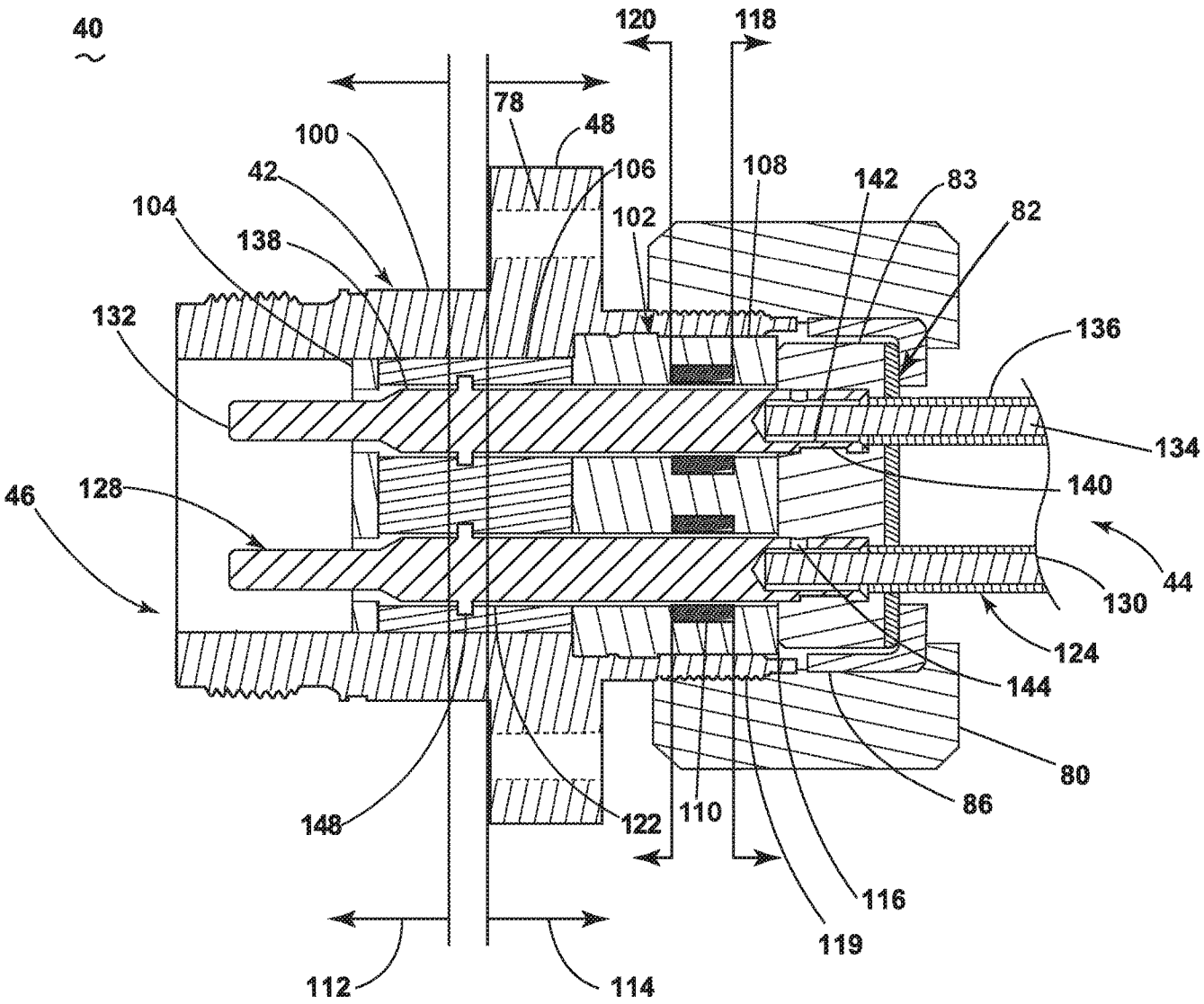
FIG. 5 is a sectional view of crimp pin electrical connector of FIG. 4, including an extended crimp pin.

FIG. 5 illustrates a sectional view of the crimp pin electrical connector 40 of FIG. 4 taken from view V-V of FIG. 4, illustrating a shell 100 of the housing 42. The shell 100 of the housing 42 can include an interior 102. The interior 102 can include an interfacial seal 104, a dielectric insert 106, a grommet 108 including at least a set of seal barriers 110. The interior 102 can be split into a first side 112 and a second side 114. In the illustrated examples of FIG. 2 and FIG. 3, the first side 112 can be in the direction of the exterior surface 72 of the avionics chassis 30 or the environment region 26 of the BUG 20. The second side 114 can be in the direction of the interior surface 70 of the avionics chassis 30 or the wet region 24 of the BUG 20. As such, at least a portion of the second side 114 can be defined as a region of the crimp pin electrical connector 40 in which gas, liquids, or other substances can accumulate. It is further contemplated that the second side 114 can be defined as a wet or sump side of the crimp pin electrical connector 40 while the first side 112 can be defined as an environment side of the crimp pin electrical connector 40.

The flange 48 can fully circumscribe the exterior of the shell 100 and at least partially form a portion of the sump. The flange 48 can be positioned and secured such that it forms a seal between the first side 112 and the second side 114 of the crimp pin electrical connector 40 such that liquids cannot leak form one side to the other. For example, in terms of the BUG 20, the flange 48 forms a seal on the housing cover 22 such that oil, lubricant, or other fluids cannot transfer from the wet region 24 to the environment region 26 through the set of holes formed within the housing cover 22.

The interfacial seal 104 can be on the first side 112 of the crimp pin electrical connector and be configured to contact at least a portion of the crimp pin electrical connector 40, specifically, the set of crimp contacts as described herein. The interfacial seal 104 can be compressed between the dielectric insert 106 and the dielectric insert 106 of an exterior connector (not shown). The exterior connector can be defined as a connection which can be electrically coupled to a portion of the crimp pin electrical connector 40 through the second opening 46. The interfacial seal 104 can be located between the dielectric insert 106 and a second opening 46 of the shell 100. It is contemplated that the interfacial seal 104 can be mated or bonded to the dielectric insert 106. The interfacial seal 104 can be formed of any suitable sealing material such as, but not limited to, fluro-silicone or the like.

The dielectric insert 106 can be provided between the interfacial seal 104 and the grommet 108. As illustrated, the dielectric insert 106 can span between the first side 112 and the second side 114 of the crimp pin electrical connector. The dielectric insert 106 can define a region of the interior 102 of the crimp pin electrical connector 40. It is contemplated, however, that the dielectric insert 106 can span along any portion of the interior 102 between the interfacial seal 104 and the grommet 108. The dielectric insert 106 can include any suitable rigid dielectric material such as, but not limited to, a glass filled dielectric material. It will be further appreciated that in some instances the interfacial seal 104 can be omitted such that the dielectric insert is retained within the interior 102 against the shell 100 toward the second opening 46.

A backshell grommet 83 can be coupled to the shell 100. The grommet 108 can be positioned between the backshell grommet 83 and the dielectric insert 106 on the second side 114 of the flange 48, otherwise known as a wet or sump side. The interface between the backshell grommet 83 and the grommet 108 can be defined by a lower wall 116. The backshell grommet 83 can further include or abut against a collar 86 circumscribing at least a portion of the backshell grommet 83. The nut 80 can be coupled to or otherwise placed over a portion of the collar 86. The nut 80 can then be threaded to a portion of the shell 100, specifically to a set of shell threads 119, such that the cap 82 is compressively retained against a portion of the collar 86. As such, the collar 86 and the cap 82 can compressively retain the backshell grommet 83 against the grommet 108 through the threading of the nut 80.

It will be appreciated that the backshell grommet 83 can be included with the grommet 108 such that they are integrally formed. Alternatively, the grommet 108 and the backshell grommet 83 can be formed as two separate pieces. Both the grommet 108 and the backshell grommet 83 can be made of a compressible, sealing material, such as fluorocarbon or fluorosilicone, while any suitable dielectric compressible material is contemplated, such as rubbers, silicones, carbons, or other materials resistant to leakage and decay.

The set of seal barriers 110 can be provided within the grommet 108 to provide for sealing within the interior of the crimp pin electrical connector 40. Specifically, the set of seal barriers 110 can provide for primary sealing through a set of passages 122 and can be located on the sump side, or second side 114 fo the flange 48. The set of seal barriers 110 can include any suitable sealing material such as, but not limited to, fluorosilicone or other sealing materials. The set of seal barriers 110 can further split the crimp pin electrical connector into a first side 118, or sump side, of the seal barriers 110 and a second side 120 of the seal barriers 110. It will be further appreciated, however, that the set of seal barriers 110 can be defined as a portion of the grommet 108. As such, the set of seal barriers 110 can be integral with the grommet 108 and made of the same material as the grommet 108. The set of seal barriers 110 can be further defined as a portion within the grommet 108 which compressively seals a portion of the crimp pin electrical connector 40, specifically the set of crimp contacts as described herein, such that a barrier is formed to prevent fluids from transferring between the first side 118 to the second side 120 of the seal barrier 110.

Each passage 122 of the set of passages 122 can extend from the first opening 44 to the second opening 46 of the housing 42. The set of passages 122 can extend in the direction of the longitudinal axis 76 (FIG. 4) and be formed within at least the interfacial seal 104, the dielectric insert 106, and the grommet 108. The set of seal barriers 110 can inscribe at least a portion of the set of passages 122. Although illustrated as a constant cross-sectional area, it will be appreciated that the set of passages 122 can have a varying cross-sectional area along the longitudinal axis 76. For example, the set of passages 122 can have a smaller cross-sectional area or contact retaining features, such as protrusions or ribs, in the dielectric insert 106.

A set of inserts or electrical inserts can be provided through the inlets 84 and into the passages 122. Each insert of the set of inserts can include a wire lead 134, an electrical insulator 124, and a crimp contact of the set of crimp contacts, specifically a crimp pin 128. Each insert can be defined by a first end 130 corresponding to the first opening 44 and a second end 132 corresponding to the second opening 46. As illustrated, there are two inserts such that two wire leads 134, two electrical insulators 124, and two crimp pins 128 are included within the crimp pin electric connector and configured to fit through at least a portion of the set of passages 122. It will be appreciated that the number of inserts can correspond to the number of passages 122. As such, the total number of crimp pins 128 can correspond to the total number of passages 122. At least a portion of each insert can extend into the shell 100 or the interior 102 at the second end 132, and through the cap 82, the collar 86 and the nut 80 near the first opening 44. It is contemplated that there can be any number of one or more inserts such that there can be any number of one or more wire leads 134, electrical insulators 124, or crimp pins 128 passing through a corresponding passage 122.

The set of electrical insulators 124 can be located entirely on the second side 114 of the flange 48. Specifically, each of the set of electrical insulators can be provided on the first side 118 of the seal barrier 110. Each electrical insulator 124 of the set of electrical insulators 124 can include a wire lead 134 or electrical lead having an insulated covering 136 extending around at least a portion of the outer circumference of the wire lead 134. The set of electrical insulators 124 can extend through at least a portion of a corresponding inlet 84 of the set of inlets 84, the cap 82, to a termination point within the backshell grommet 83. The set of wire leads 134 can terminate within a portion of the set of crimp pins 128 located within a portion of the grommet 108.

At least some of the set of crimp pins 128 can include a pin 138 and a crimp 140. The crimp pin 128 can be configured such that the pin 138 is the only portion of the crimp pin 128 which extends into the first side 112 of the flange 48. As such, the pin 138 can extend within the set of passages 122 through at least a portion of the grommet 108, the dielectric insert 106, the interfacial seal 104 and ultimately into a portion of the shell 100. The pin 138 can extend from the first side 112 of the flange 48 to at least a portion of the second side 114 of the flange 48, or to at least a portion of the first side 118 of the seal barrier 110. The pin 138 can further include a retention shoulder 148 defined as a portion of the pin 138 which extends into the passage 122 from an outer surface of the pin 138. The retention shoulder 148 can be configured to fit within a portion of passage 122 or the dielectric insert 106 to provide for a lock or retention method for the crimp pin 128. Additionally, the passage 122 within the dielectric insert 106 can have a variable cross-sectional area containing metal contact retention tines or other various contact retaining features for retention of at least a portion of the crimp pin 128, specifically the pin 138.

The crimp 140 is located entirely within the second side 114 of the flange 48. Specifically, the crimp 140 is located entirely within the first side 118 of the seal barrier 110. As such, the crimp 140 can extend along at least a portion of the crimp pin 128 on the first side 118 of the seal barrier 110. The crimp 140 can be configured to deform at least a portion of a barrel 142 positioned entirely on the second side 114 of the flange 48 or entirely on the first side 118 of the seal barrier 110. Specifically, the barrel 142 or the crimp 140 can be located at least partially within the grommet 108 and the backshell grommet 83. Specifically, it is contemplated that at least a portion of the crimp 140 can be received within a portion of a corresponding passage 122 that extends through the grommet 108. The barrel 142 can be configured such that it can circumscribe at least a portion of the wire leads 134.

The barrel 142 can further include an inspection hole 144 which can extend through one or both walls of the crimp pin 128 at the barrel 142. The inspection hole 144 can be formed as a circular hole or any other hole such as, but not limited to, a slot or a slit. The inspection hole 144 can be located entirely on the second side 114 of the flange 48, specifically, on the first side 118 of the seal barrier 110. It will be further appreciated that each barrel 142 can include a set of inspections holes 144. As such, there can be any number of one or more inspection holes 144 included on the barrel 142.

The crimp 140 can be further defined as a portion of the crimp pins 128 which can compressively retain at least a portion of the wire lead 134. The crimp 140 can decrease a local cross-sectional area of the barrel 142 such that the barrel 142 presses up against the wire lead 134 and compressively retains the wire leads 134. As such, the crimp can operatively couple the crimp pin 128 to the electrical insulator 124. It is contemplated that the crimp 140 can additionally be located around another portion of the electric insulator 124 such as the insulated cover 136. Additionally, or alternatively, it is contemplated that the crimp 140 be one of a set of crimps 140 located at various suitable locations along the crimp pin 128. For example, there can be a first crimp 140 located around the wire lead 134 as illustrated and a second crimp 140 located around a portion of the insulated cover 136.

The crimp pin electrical connector or crimp contact as described herein provides for an improved environmental seal compared to conventional crimp pin electrical contacts. For example, in terms of the BUG during operation, internal pressure and fluids can be exerted on the crimp pin electrical connector. In conventional crimp pin electrical connectors liquid, gas, or other substances can leak along a portion of stranded wire of the wire lead exposed to the fluids, and within the insulated covering around the wire lead. A space can be present between the end of the contact and the insulated covering of the wire lead such that fluids can leak into portions of the contact or crimp pin electrical connector. Additionally, the open end of the barrel and inspection hole in conventional crimp pin electrical connectors can provide for a fluid leakage path. As the termination of the insulated covering, crimp, inspection hole and any other leakage paths described herein in conventional crimp pin electrical connectors is located on the second side of the seal barriers, any leaking fluid will egress around the pins of the crimp pins and into regions of the crimp pin electrical connector on the first side of the flange or environment. The crimp pin electrical connector is extended as described herein, such that it eliminates the leaking caused by a pressure vent across the connector by establishing the, the crimp, inspection hole, and the termination of the insulated covering of the crimp pin electrical connector on the second side of the flange, specifically, the first side of the seal barriers. Pressure and fluid, like that generated from BUG operation, can remain entirely within the first side of the seal barriers on the second side of the flange. As such, internal pressure and fluids remain sealed within the pressure vessel by eliminating leak paths unaddressed by standard contacts in the crimp pin electrical connector or crimp pin electrical contact. Further, any fluid wicking along stranded wire leads feeding into the connector, despite the lack of a pressure vent across the connector, will be constrained internal to the sump where the fluid is already expected.

Further benefits of the crimp pin electrical connector as described herein include an increased stabilization of the crimp pin. The increased stabilization is due in part to the extended design of the crimp pin when compared to conventional crimp pins. For example, conventional crimp pin deigns can extend only partially onto the second side of the flange and terminate fully within the second side of the seal barriers. The wire lead, crimped to the crimp pin, is left relatively unsupported through the seal barriers when compared to the crimp pin of the present disclosure. In the event that the insert or the crimp pin electrical connector is put under external loads which can create a side loading, the fluids can bypass the seal between the wire lead and the seal barriers. Additionally, if there is no wire lead connected to a crimp pin of a conventional crimp pin electrical connector, then the seal barriers will not be engaged and fluids will leak around the conventional crimp pin to the external environment. The crimp pin as described herein extends fully through the passage on the second side of the flange, the first side of the seal barrier, through the grommet, and into the backshell grommet. As such, the grommet and additionally the backshell grommet can act as a constraint to better stabilize the crimp pin when compared to conventional crimp pin designs. The increased stability of the extended crimp pin as described herein ensures that the extended crimp pin remains engaged with the seal barriers through side loading of the wire leads, insert, or crimp pin electrical connector.

It is further contemplated that the crimp pin electrical connector as described herein can allow for improved installation and removal of crimp pins than when compared to conventional electrical connectors, specifically hermetic electrical connectors. For example, hermetic electrical connectors can require soldering between the crimp pin and the wire lead. This can add another layer of difficulty for manufacturing when connecting a hermetic connector to an assembly as soldering can require skilled and certified operators. The crimp pin electrical connector as described herein, however, is configured such that it can be repeatedly installed and removed from the crimp pin electrical connector without soldering. As such, the extended crimp pin can be installed and removed from a crimp pin electrical connector using the same tools and in the same manner as a conventional crimp pin.

Many other possible configurations in addition to that shown in the above figures are contemplated by the present disclosure. To the extent not already described, the different features and structures of the various aspects can be used in combination with others as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the invention, including the best mode, and also to enable any person skilled in the art to practice aspects of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

A crimp pin electrical connector comprising a shell defining an interior with a first opening and a second opening to define an axial path through the shell between the first opening and the second opening, a flange circumscribing an exterior of the shell, and an insert located within the interior and comprising a first end corresponding to the first opening, a second end corresponding to the second opening, and at least one passage extending between the first end and the second end, the insert comprising: at least one crimp pin corresponding to the at least one passage, with at least some of the at least one crimp pin comprising a pin and a crimp, wherein the at least one crimp pin is located within the at least one passage such that a portion of the at least one crimp pin is located on a first side of the flange and the crimp lies on a second side, opposite the first side, of the flange.

The crimp pin electrical connector of any preceding clause wherein the flange is located between the first opening and the second opening.

The crimp pin electrical connector of any preceding clause wherein the insert further includes an electrical insulator and a wire lead.

The crimp pin electrical connector of any preceding clause wherein the at least one crimp pin is included within a set of crimp pins and the at least one passage is included within a set of passages, wherein the total number of crimp pins included within the set of crimp pins corresponds to the total number of passages included within the set of passages.

The crimp pin electrical connector of any preceding clause wherein the at least one crimp pin has a barrel, which is located on the second side of the flange.

The crimp pin electrical connector of any preceding clause wherein the barrel comprises an inspection hole, which is located on the second side of the flange.

The crimp pin electrical connector of any preceding clause wherein the barrel comprises a slot or a slit.

The crimp pin electrical connector of any preceding clause wherein the at least one passage extends through a grommet an at least a portion of the crimp is received within a portion of the at least one passage extending through the grommet.

The crimp pin electrical connector of any preceding clause further comprises a seal barrier defining a first side and a second side of the seal barrier.

The crimp pin electrical connector of any preceding clause wherein the crimp is located entirely on the first side of the seal barrier.

A wall of an electrical assembly comprising a first surface, a second surface opposite the first surface, and a hole located in the wall, a shell defining an interior with a first opening and a second opening to define an axial path through the wall between the first opening and the second opening, the shell having a flange circumscribing an exterior of the shell, with at least a portion of the shell extending through the hole and the flange abutting the first surface, and an insert located within the interior and comprising a first end corresponding to the first opening, a second end corresponding to the second opening, and at least one passage extending between the first end and the second end, the insert comprising at least one crimp pin corresponding to the at least one passage, the at least one crimp pin comprising a pin and a crimp, wherein the at least one crimp pin is located within the at least one passage such that a portion of the pin is axially located on a first side of the flange and the crimp is axially located on a second side of the flange.

The wall of any preceding clause wherein the wall is a housing cover of a Back-up Generator.

The wall of any preceding clause wherein the flange is located between the first opening and the second opening.

The wall of any preceding clause wherein the insert further includes an electrical insulator and a wire lead.

The wall of any preceding clause wherein the at least one crimp pin is included within a set of crimp pins and the at least one passage is included within a set of passages, wherein the total number of crimp pins included within the set of crimp pins corresponds to the total number of passages included within the set of passages.

The wall of any preceding clause wherein the at least one crimp pin has a barrel, which is located on the second side.

The wall of any preceding clause wherein the barrel comprises an inspection hole, which is located on the second side.

The wall of any preceding clause wherein the barrel comprises a slot or a slit.

The wall of any preceding clause further comprising a grommet including a seal barrier defining a first side and a second side.

The wall of any preceding clause wherein the crimp is located entirely on the first side of the seal barrier.

What is claimed is:

1. A wall of an electrical assembly separating a first area containing a fluid and a second area, the wall comprising:

a first surface, a second surface opposite the first surface, and a hole located in the wall;

a shell defining an interior with a first opening and a second opening to define an axial path through the wall between the first opening and the second opening, the shell having a flange circumscribing an exterior of the shell, with at least a portion of the shell extending through the hole and the flange abutting the first surface;

an insert located within the interior and comprising a first end corresponding to the first opening, a second end corresponding to the second opening, and at least one passage extending between the first end and the second end, the insert comprising:

at least one crimp pin corresponding to the at least one passage, the at least one crimp pin comprising a pin and a crimp; and a seal barrier forming a portion of the passage and compressively sealing at least a portion of at least one crimp pin, the seal barrier having a first side and a second side with the seal barrier being configured to limit an egress of the fluid from the first side to the second side;

wherein the at least one crimp pin is located within the at least one passage such that a portion of the pin is axially located on a first side of the flange and the crimp is axially located on a second side of the flange.

2. The wall of claim 1 wherein the wall is a housing cover of a Back-up Generator.

3. The wall of claim 1 wherein the flange is located between the first opening and the second opening.

4. The wall of claim 1 wherein the insert further includes an electrical insulator and a wire lead.

5. The wall of claim 1 wherein the at least one crimp pin is included within a set of crimp pins and the at least one passage is included within a set of passages, wherein a total number of crimp pins included within the set of crimp pins corresponds to a total number of passages included within the set of passages.

6. The wall of claim 1 wherein the at least one crimp pin has a barrel, which is located on the second side.

7. The wall of claim 6 wherein the barrel comprises an inspection hole, which is located on the second side.

8. The wall of claim 1, further comprising a grommet and the seal barrier defining a first side and a second side, wherein the crimp is located entirely on the first side of the seal barrier.

9. The wall of claim 8, wherein the seal barrier is integrally formed with the grommet.

10. A crimp pin electrical connector comprising:

a shell defining a passage;

a grommet forming a first portion of the passage;

a backshell grommet confronting a portion of the grommet and forming a second portion of the passage;

a seal barrier that splits the crimp pin electrical connector into a first side and a second side, the first side being a sump side; and at least one crimp pin extending through a portion of the passage, the at least one crimp pin having a pin and a crimp, with the crimp being located entirely within the first side.

11. The crimp pin electrical connector of claim 10, wherein the seal barrier forms a third portion of the passage.

12. The crimp pin electrical connector of claim 11, wherein the seal barrier compressively seals a portion of the crimp pin.

13. The crimp pin electrical connector of claim 11, wherein the seal barrier includes a first side and a second side, with the first side corresponding to the sump side.

14. The crimp pin electrical connector of claim 10, wherein the seal barrier is formed within the grommet.

15. The crimp pin electrical connector of claim 10, wherein the seal barrier is integrally formed with the grommet.

16. The crimp pin electrical connector of claim 10, wherein the backshell grommet is separate from the grommet.

* * * * *